United States Patent [19]

LaBelle et al.

[11] Patent Number: 4,639,412

[45] Date of Patent: Jan. 27, 1987

[54] RESISTIVELY HEATED PHOTOTHERMOGRAPHIC MEDIA ON VESICULAR SUBSTRATE

[75] Inventors: Gary E. LaBelle, Hugo, Minn.; David T. Ask, Somerset, Wis.

[73] Assignee: Minnesota Mining and Manufacturing Company, St. Paul, Minn.

[21] Appl. No.: 873,817

[22] Filed: Jun. 13, 1986

[51] Int. Cl.[4] ..... G03C 1/84

[52] U.S. Cl. ..... 430/523; 430/531; 430/617; 430/619; 430/620

[58] Field of Search ..... 430/523, 531, 617, 619, 430/620

[56] References Cited

U.S. PATENT DOCUMENTS

| | | | |
|---|---|---|---|
| 4,055,432 | 10/1977 | Masuda et al. | 430/523 |
| 4,403,031 | 9/1983 | Borrelli et al. | 430/523 |
| 4,409,316 | 10/1983 | Zeller-Pendrey et al. | 430/263 |
| 4,460,681 | 7/1984 | Frenchik | 430/502 |

*Primary Examiner*—Jack P. Brammer

*Attorney, Agent, or Firm*—Donald M. Sell; James A. Smith; Mark A. Litman

[57] ABSTRACT

The use of a reflective white substrate comprising a polymeric film containing both vesicles and white pigment provides a good background layer for photothermographic emulsions which improves image properties.

20 Claims, No Drawings

RESISTIVELY HEATED PHOTOTHERMOGRAPHIC MEDIA ON VESICULAR SUBSTRATE

BACKGROUND OF THE INVENTION

1. Field of the Invention

The present invention relates to dry silver photothermographic imaging materials and to resistively developable photothermographic materials on polymeric substrates.

2. Prior Art

Photosensitive, heat-developable, dry silver sheet materials, as described for example in U.S. Pat. Nos. 3,457,075 and 3,839,049, contain a photosensitive silver halide catalyst-forming means in catalytic proximity with a heat sensitive combination of a light stable organic silver compound and a reducing agent therefor. When struck by light, the silver halide catalyst-forming means produces silver nuclei which serve to catalyze the reduction of the organic silver compound, e.g., silver behenate, by the reducing agent at elevated temperatures.

Color photothermographic imaging systems have been described in patent literature. U.S. Pat. No. 3,531,286 describes a system using paraphenylenediamine and photographic color couplers. U.S. Pat. No. 3,985,565 discloses the use of phenolic leuco dye reducing agents to reduce the silver and provide a color image. U.S. Pat. No. 4,460,681 discloses a multilayer color photothermographic system using a variety of leuco dyes separated by barrier layers.

It has been found to be desirable to provide a resistive layer in the photothermographic element which can be used as an integral heating means for the thermal development of the element. A voltage is applied across the resistive layer and the layer becomes heated, providing a uniform heat development of the exposed element. In order to utilize this type of resistive heating with transparent photothermographic media, it has been necessary to make the resistive layer strippable as shown in U.S. Pat. No. 4,409,316. Because the resist layer is most desirably a film with a high concentration of carbon black, the resist layer must be removed from the transparent substrate in order to allow viewing of the image.

Photothermographic media are also available with paper substrates. Resistive layers can be used on the backside of these photothermographic papers, but there are a number of sensitometric losses incurred. Paper substrates tend to cause more graininess and mottling than polymeric film substrates when coated with the same photothermographic emulsions, even when the paper substrate has a polymeric coating on its surface. Furthermore, paper is an insulator and the heating through that substrate tends to be less even than through a polymeric layer.

BRIEF DESCRIPTION OF THE INVENTION

In accordance with the practice of the present invention, it has now been found possible to provide photosensitive, resistively heat-developable, dry silver imaging sheets which give good, high quality images on an opaque polymeric substrate which gives the appearance of a black-on-white image.

DETAILED DESCRIPTION OF THE INVENTION

Initial attempts to convert polymeric material into a white opaque substrate with a resistive backing were unsuccessful. Subbing layers of $TiO_2$ in a polymeric binder were not satisfactory for a number of reasons. When the $TiO_2$ content was high enough to provide whiteness equivalent to that of paper, the conventional binder formulation did not adhere well and could be too easily removed from the polymeric substrate. Furthermore, the presence of $TiO_2$ in the layer adjacent the photothermographic emulsion reduced the stability of the emulsion. The high content of $TiO_2$ in the layer apparently allowed some molecular migration or interface contamination into the emulsion layer.

It has been found in the present invention that a polymeric substrate having a combination of optically reflecting vesicles and white pigment provides an opaque white substrate which provides the reduced mottle and reduced graininess associated with photothermographic images on transparent base and also provides increased development latitude and the appearance of a black-on-white paper image, and that this substrate can be used with a resistive backside layer. The opacity of the layer is sufficient to mask out the tones or color of the resistive backside layer.

The substrate comprises a polymeric film having a combination of vesicles and white pigments sufficient to provide a transmission optical density to white light of at least 1.5 with the vesicles comprising at least 1% by volume of the film layer and the pigments comprising at least 1% by weight of said film layer. Preferably the substrate has an optical transmission density to white light of at least 2.0 and more preferably at least 3.0. Preferably the vesicles comprise at least 2% by volume of the film and more preferably comprise at least 4% by volume of the film. Preferably the pigment comprises at least 2% by weight of the film and more preferably at least 4% by weight of the film. The pigment may comprise from 1 to 75% by weight of the polymeric film and preferably from 2 to 50% by weight of the film. The vesicles may comprise from 1 to 50% by volume of the film and preferably comprise 2 to 35% by volume of the film. The vesicles are preferably from 0.01 to 20 microns in diameter, but may be of any size (e.g., 0.005 to 50 microns) that can provide transmission optical density and reflectance to white light (420–750 nm). The white pigment may be any white pigment such as titania, zinc oxide, barium sulfate, etc. The higher the reflectance of the pigment, the generally more preferred the pigment. The vesicles should be stable at the thermal development temperatures and should not completely collapse when subjected to 135° C. for five seconds.

The resistive layer may have a resistance between 40 and 3,500 ohms per square and can be any material which provides that physical property. One can use insulative material which is filled with a sufficient amount of conductive particles, flakes or fibers to provide the required resistance, one can use a conductive material filled with insulative particles, flakes or fibers, or one can select a material naturally having the required resistivity.

The preferred resistive layers of the present invention comprise polymeric resin filled with conductive material. For example, filler such as carbon black, graphite, metal, conductive polymers (e.g., polymers having quaternary ammonium groups thereon) and other generally available materials may be used. The binder or resin of the resistive layer may be any material which provides the physical properties necessary. Such resins as polyesters, polyamides, polyolefins, polyvinyls, polyethers, polycarbonates, gelatin, cellulose esters, polyvinyl acetals and the like are all useful.

Photothermographic dry silver emulsions are usually constructed as one or two layers on a substrate. Single layer constructions must contain the silver source material, the silver halide, the developer and binder as well as optional additional materials such as toners, coating aids and other adjuvants. Two-layer constructions must contain the silver source and silver halide in one emulsion layer (usually the layer adjacent the substrate) and some of the other ingredients in the second layer or both layers.

The silver source material, as mentioned above, may be any material which contains a reducible source of silver ions. Silver salts of organic acids, particularly long chain (10 to 30, preferably 15 to 28 carbon atoms) fatty carboxylic acids are preferred. Complexes of organic or inorganic silver salts wherein the ligand has a gross stability constant between 4.0 and 10.0 are also desirable. The silver source material should constitute from about 20 to 70 percent by weight of the imaging layer. Preferably it is present as 30 to 55 percent by weight. The second layer in a two-layer construction would not affect the percentage of the silver source material desired in the single imaging layer.

The silver halide may be any photosensitive silver halide such as silver bromide, silver iodide, silver chloride, silver bromoiodide, silver chlorobromoiodide, silver chlorobromide, etc., and may be added to the emulsion layer in any fashion which places it in catalytic proximity to the silver source. The silver halide is generally present as 0.75 to 15 percent by weight of the imaging layer, although larger amounts up to 20 or 25 percent are useful. It is preferred to use from 1 to 10 percent by weight silver halide in the imaging layer and most preferred to use from 1.5 to 7.0 percent.

The reducing agent for silver ion may be any material, preferably organic material, which will reduce silver ion to metallic silver. Conventional photographic developers such as phenidone, hydroquinones, and catechol are useful, but hindered phenol reducing agents are preferred. The reducing agent should be present as 1 to 10 percent by weight of the imaging layer. In a two-layer construction, if the reducing agent is in the second layer, slightly higher proportions, of from about 2 to 15 percent tend to be more desirable.

Toner materials may also be present, for example, in amounts of from 0.2 to 10 percent by weight of all silver-bearing components. Toners are well known materials in the photothermographic art as shown by U.S. Pat. Nos. 3,080,254; 3,847,612 and 4,123,282. Spectral sensitizing dyes may also be used with the emulsions.

The binder may be selected from any of the well-known natural and synthetic resins such as gelatin, polyvinyl acetals, polyvinyl chloride, polyvinyl acetate, cellulose acetate, polyolefins, polyesters, polystyrene, polyacylonitrile, polycarbonates, and the like. Copolymers and terpolymers are of course included in these definitions. The polyvinyl acetals, such as polyvinyl butyral and polyvinyl formal, and vinyl copolymers such as polyvinyl acetate/chloride are particularly desirable. The binders are generally used in a range of from 20 to 75 percent by weight of each layer, and preferably about 30 to 55 percent by weight.

It is also found convenient to use silver halfsoaps, of which an equimolar blend of silver behenate and behenic acid, prepared by precipitation from aqueous solution of the sodium salt of commercial behenic acid and analyzing about 14.5 percent silver, represents a preferred example. Transparent sheet materials made on transparent film backing require a transparent coating and for this purpose the silver behenate full soap, containing not more than about four or five percent of free behenic acid and analyzing about 25.2 percent silver, may be used. Other components, such as coloring, opacifiers, extenders, spectral sensitizing dyes, etc. may be incorporated as required for various specific purposes. Antifoggants, such as mercuric salts and tetrachlorophthalic anhydride, may also be included in the formulation.

The substrate with backside resistive heating layer may also be used in color photothermographic imaging systems such as shown in U.S. Pat. Nos. 4,460,681 and 4,374,921.

EXAMPLE 1

A photothermographic element was constructed comprising a support base coated with a first layer comprising 364 parts silver behenate, 1021 parts of polyvinyl butyral, 8.76 parts $HgBr_2$ in 71 parts methanol, 0.226 parts and 0.114 parts of merocyanine spectral sensitizing dyes (Lith 454 dye disclosed in U.S. Pat. No. 4,260,677 and the dye formula shown below) in 165.8 parts methanol, 200.4 parts 1,1-bis(2-hydroxy-3,5-dimethylphenyl-3,5,5-trimethylhexane and 2220 parts toluene and 4221 parts acetone. The solution was coated at 100 microns wet thickness and dried in a forced air draft at 85° C. for two minutes. A second trip coating of 5600 parts acetone, 1110 parts methanol, 2745 parts methylethylketone, 51.4 parts phthalazine, 35.6 parts 4-methylphthalic acid, 10.6 parts tetrachlorophthalic acid and 450 parts cellulose acetate were coated and dried to a dry coating weight of about 2.04 $g/m^2$.

To the backside of the support base was coated ethyl cellulose in an ethanol/toluene solvent solution with 46 weight percent carbon black to the solids weight of the dry coating and dried at 80° C. for three minutes. The resistive coating was 0.85 $g/ft^2$ (6.4 $g/m^2$).

The completed photothermographic element was exposed through a 0–4 step wedge to a xenon flash light source. A voltage of 160 volts was applied across the resistive layer (10.2×10.2 cm) for 2–5 seconds. Sufficient heat was generated to develop the silver image to a Dmax of greater than 1.3.

The various substrates used as the support base were (a) 60 lb. supercalendered paper with a 66% by weight $TiO_2$/polymer prime layer, (b) polyester film having a prime layer of about 66% by weight $TiO_2$ in poly(vinyl butyral), and (c) polyethylene terephthalate having approximately 10% by volume of 200 nm vesicles and 15% by weight of barium sulfate white pigment which provided a reflectance to white light of greater than 50% and an optical transmission density to white light of greater than 2.0.

Both b and c showed reduced mottle and reduced graininess as compared to the paper base. The adhesion of the emulsion to support c was far superior to that of b. The pigmented layer could be readily removed by tape from the polymer base. The post development print stability of the emulsion on base b was also far less than that on base c.

The dye formula of the second dye in this example is

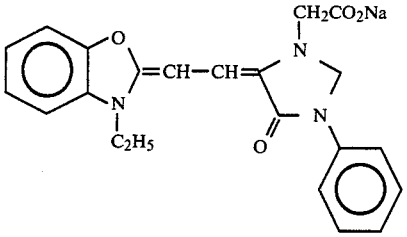

made by conventional synthetic procedures substantially the same as those used to make the Lith 454 dye described in U.S. Pat. No. 4,260,677.

I claim:

1. A photothermographic element comprising an opaque substrate having at least one photothermographic emulsion coated on one side of said substrate and a resistively heatable layer adhered to the other side of said substrate, said emulsion comprising silver halide in reactive association with a light-insensitive organic silver salt, a reducing agent for silver ion, and an organic film having at least 1% by volume of vesicles, at least 1% by weight of white pigment and an optical transmission density at least 1.5 to white light.

2. The element of claim 1 wherein said substrate has an optical transmission density to white light of at least 2.0.

3. The element of claim 1 wherein said substrate comprises 1 to 50% by volume of vesicles.

4. The element of claim 1 wherein said substrate comprises from 2 to 35% by volume of vesicles.

5. The element of claim 1 wherein said vesicles are from 0.01 to 20 microns in diameter.

6. The element of claim 3 wherein said vesicles are from 0.01 to 20 microns in diameter.

7. The element of claim 4 wherein said vesicles are from 0.01 to 20 microns in diameter.

8. The element of claim 1 wherein said pigment comprises 1 to 75% by weight of said substrate.

9. The element of claim 3 wherein said pigment comprises 1 to 75% by weight of said substrate.

10. The element of claim 4 wherein said pigment comprises 1 to 75% by weight of said substrate.

11. The element of claim 5 wherein said pigment comprises 1 to 75% by weight of said substrate.

12. The element of claim 7 wherein said pigment comprises 1 to 75% by weight of said substrate.

13. The element of claim 1 wherein said pigment comprises 2 to 50% by weight of said substrate.

14. The element of claim 3 wherein said pigment comprises 2 to 50% by weight of said substrate.

15. The element of claim 5 wherein said pigment comprises 2 to 50% by weight of said substrate.

16. The element of claim 7 wherein said pigment comprises 2 to 50% by weight of said substrate.

17. The element of claim 3 wherein said pigment is selected from the group consisting of titania, barium sulfate, and zinc oxide.

18. The element of claim 16 wherein said pigment is selected from the group consisting of titania, barium sulfate, and zinc oxide.

19. The element of claim 1 wherein said emulsion comprises a color photothermographic emulsion.

20. The element of claim 16 wherein said emulsion comprises a color photothermographic emulsion.

* * * * *